US005280925A

United States Patent [19]

Lowell

[11] Patent Number: 5,280,925

[45] Date of Patent: Jan. 25, 1994

[54] FIXTURING PLATE FOR STITCHER

[75] Inventor: Kenneth W. Lowell, Bristol, Conn.

[73] Assignee: Pitney Bowes Inc., Stamford, Conn.

[21] Appl. No.: 52,030

[22] Filed: Apr. 19, 1993

[51] Int. Cl.[5] ..... B25C 7/00

[52] U.S. Cl. ..... 227/155

[58] Field of Search ..... 227/155, 154

[56] References Cited

U.S. PATENT DOCUMENTS

| | | | |
|---|---|---|---|
| 694,031 | 2/1902 | Schmidt, Jr. | 227/155 |
| 892,827 | 7/1908 | Graves | 227/155 |
| 2,019,990 | 11/1935 | Newhouse | 227/155 |
| 2,867,810 | 1/1959 | Gagnon | 227/155 |
| 2,904,786 | 9/1959 | Hazel et al. | 227/155 |
| 4,479,642 | 10/1984 | Macey | 227/155 |

*Primary Examiner*—Scott Smith

*Attorney, Agent, or Firm*—Charles R. Malandra, Jr.; Melvin J. Scolnick

[57] ABSTRACT

An improvement in a stitcher for stapling documents. The stitcher includes a pair of side plates, a stitch head mounting bar secured to the side plates, a clincher mounting bar secured to the side plates, a stitch head mounted on the stitch head mounting bar, and a clincher mounted on the clincher mounting bar. The improvement consists of a fixturing plate secured to the stitch head mounting bar and to the clincher mounting bar.

3 Claims, 3 Drawing Sheets

FIXTURING PLATE FOR STITCHER

BACKGROUND OF THE INVENTION

The instant invention relates to stitching (stapling) apparatus used in document feeding systems, and more particularly to the stitch head support bar and the clincher support bar in a stitching device.

There are many applications today in which documents are fed along a feed path and then collated for further processing. In many cases the documents must be properly aligned prior to insertion into an envelope. In a significant number of applications, it is necessary that the documents be secured to one another, i.e. stitched or stapled together. There is a universal stitcher that is well known in the art and it is available for a variety of applications in which stapling of documents is required. However, experience with this universal stitcher has revealed several problems maintaining alignment of the stitch head to the clincher due to the fact that both the stitch head mounting bar and the clincher mounting bar were secured independently of each other. When the mounting bars are not properly aligned, the staples are not consistently formed.

The instant invention accordingly overcomes the problems associated with the prior art stitcher by providing a fixturing plate which secures the stitch head mounting bar and the clincher mounting bar to each other in order to assure that the staples are consistently aligned to the clincher.

SUMMARY OF THE INVENTION

Thus, the instant invention provides an improvement in a stitcher for stapling documents. The stitcher includes a pair of side plates, a stitch head mounting bar secured to the side plates, a clincher mounting bar secured to the side plates, a stitch head mounted on the stitch head mounting bar, and a clincher mounted on the clincher mounting bar. The improvement comprises a fixturing plate secured to the stitch head mounting bar and to the clincher mounting bar.

DETAILED DESCRIPTION OF THE PREFERRED EMBODIMENT

Figure 1:
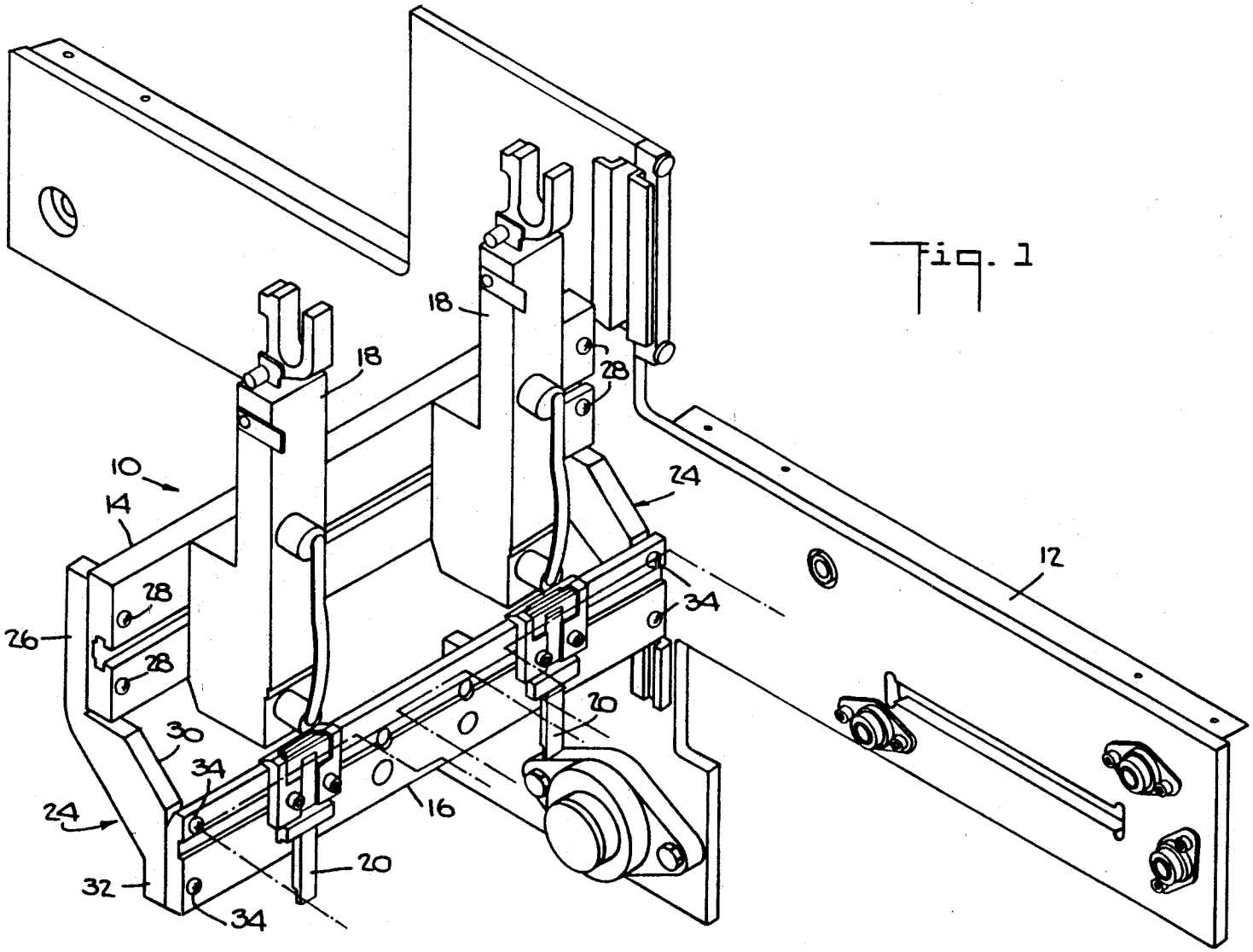
FIG. 1 is a perspective view of a universal stitcher mechanism in accordance with the instant invention.
Figure 2:
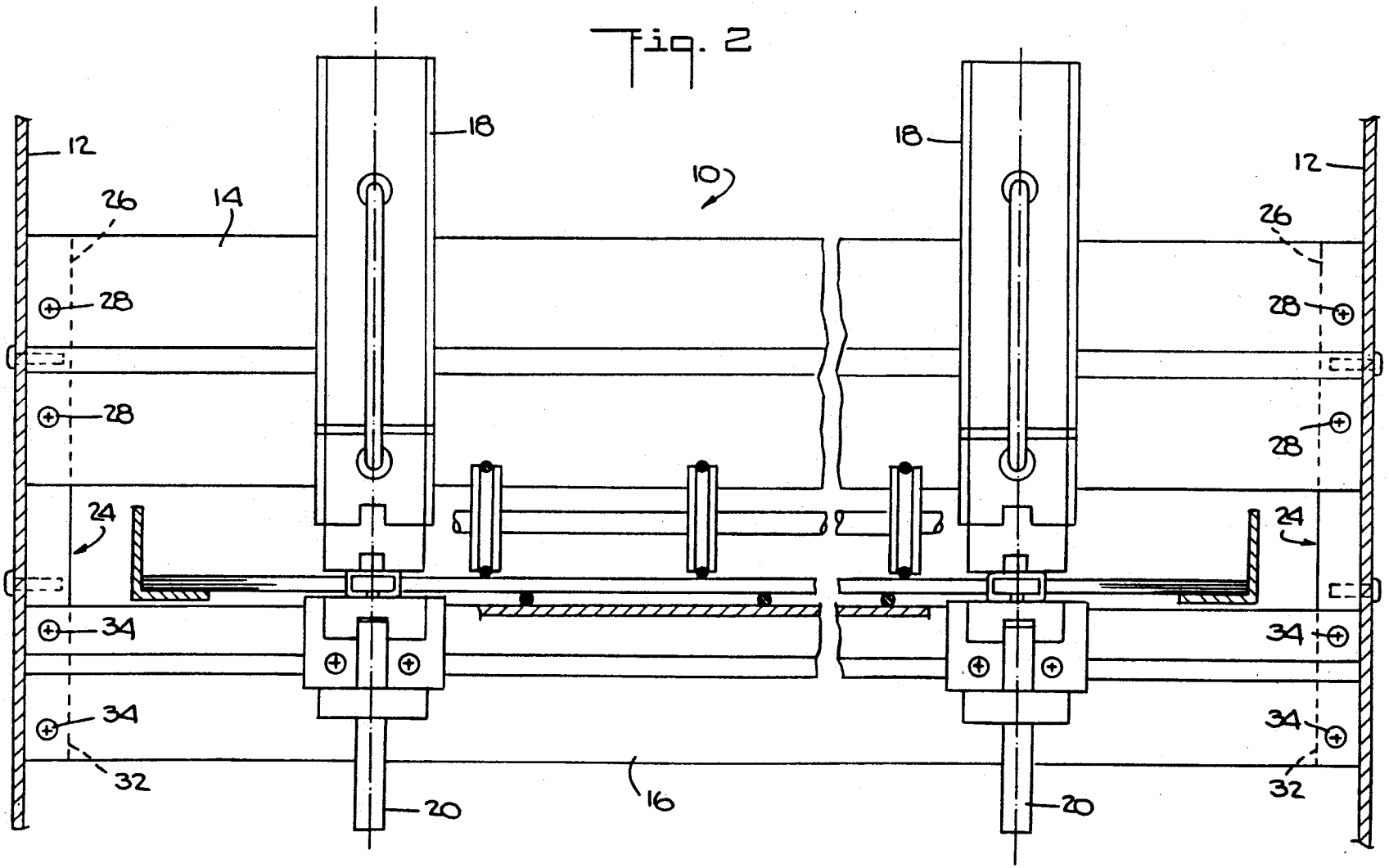
FIG. 2 is a front, elevational view of the stitcher mechanism seen in FIG. 1.
Figure 3:
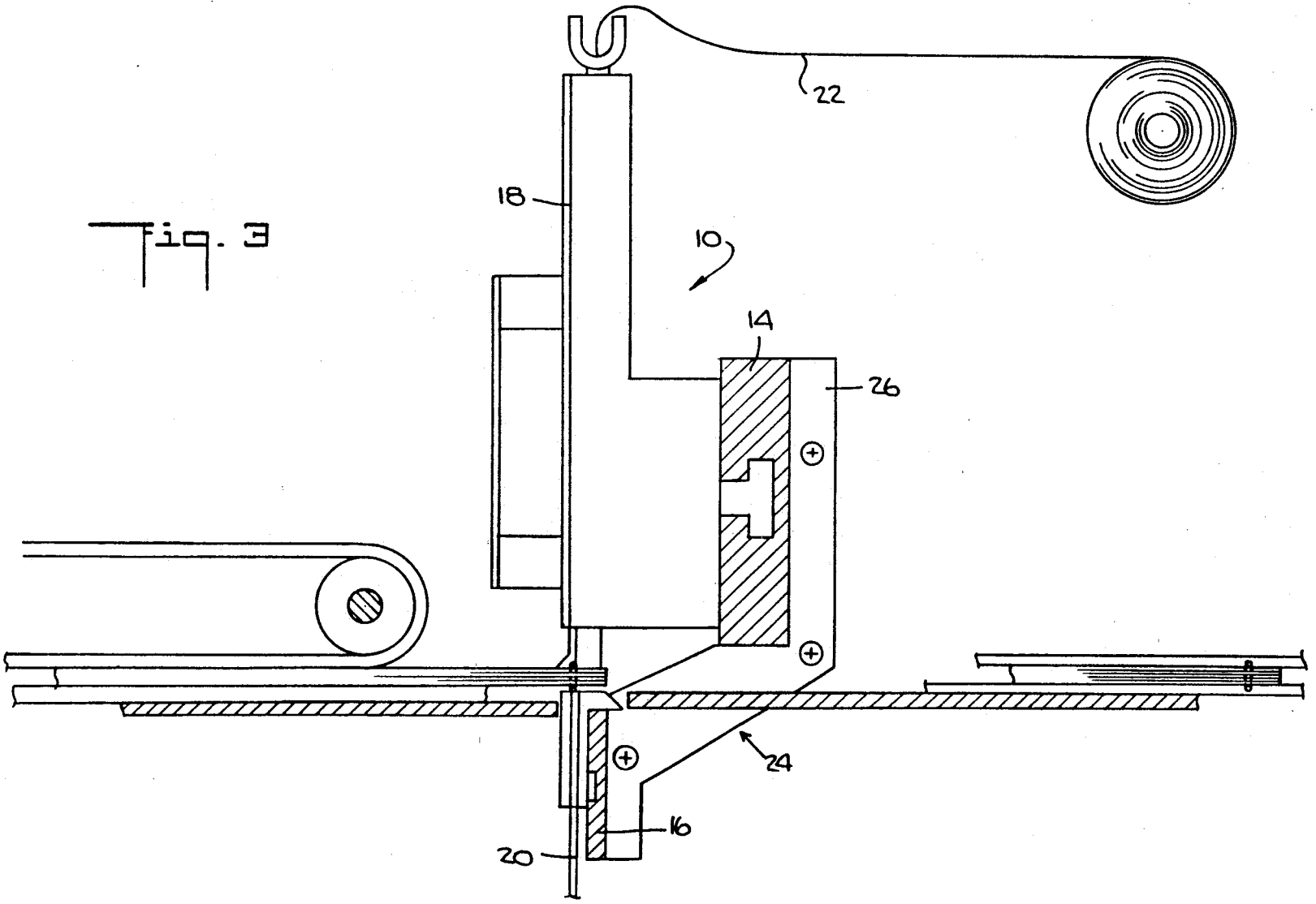
FIG. 3 is a side, elevational view of the stitcher mechanism seen in FIG. 1.

In describing the preferred embodiment of the instant invention, reference is made to the drawings, wherein there is seen a stitcher generally designated 10 which is employed in many document feeding systems to staple together a collation of documents. The stitcher 10 includes a pair of side plates 12 on which are fixedly mounted a stitch head mounting bar 14 and a clincher mounting bar 16. The stitch head mounting bar 14 supports the two stitch heads 18 and the clincher mounting bar 16 supports the two clinchers 20. The stitch head 18 feeds the section of wire 22 through the documents (not shown) to be stapled (stitched) toward the clincher 20 which bends the ends of the wire 22 to form a staple in a conventional process which is well known.

As seen above, both the stitch head mounting bar 14 and the clincher mounting bar 16 are secured to the side plates 12. A pair of fixturing plates 24 secure the stitch head mounting bar 14 to the clincher mounting bar 16 at the ends thereof. Each fixturing plate 24 includes a vertical, upper section 26 which is secured by screws 28 to the stitch head mounting bar 14, an angled, intermediate section 30 and a lower, vertical section 32 which is secured by screws 34 to the clincher mounting bar 16.

In operation, it is desired that the wire to be formed into a staple be driven by the stitch heads 18 through the documents to be stapled toward the clinchers 20 consistently in the same location. The fixturing plates 24 secure the stitch head mounting bar 14 to the clincher mounting bar 16, thereby minimizing or eliminating any relative movement between the two bars 14 and 16. Thus, the fixturing plates 24 assure that the stitch heads 18 and the clinchers 20 are precisely aligned with respect to each other, thereby assuring that the staple wires are precisely driven toward the clinchers 20 on a consistent basis.

From the foregoing description, it can be seen that the stitch heads 18 and the clinchers 20 are consistently and precisely aligned with respect to each other. This consistent, precise alignment assures that the staples are consistently and properly formed.

It should be understood by those skilled in the art that various modifications may be made in the present invention without departing from the spirit and scope thereof, as described in the specification and defined in the appended claims.

What is claimed is:

1. In a stitcher for stapling documents, said stitcher including a pair of side plates, a stitch head mounting bar secured to said side plates, a clincher mounting bar secured to said side plates, a stitch head mounted on said stitch head mounting bar, and a clincher mounted on said clincher mounting bar, the improvement comprising a fixturing plate secured to both said stitch head mounting bar and to said clincher mounting bar adjacent at least one of said of side plate

2. The improvement of claim 1, wherein said fixturing plate includes a vertical, upper section secured to said stitch head mounting bar and a lower, vertical section secured to said clincher mounting bar.

3. The improvement of claim 2, wherein said fixturing plate includes an angled section intermediate said upper and lower sections.

* * * * *